US010352548B2

(12) United States Patent
Bizzotto

(10) Patent No.: US 10,352,548 B2
(45) Date of Patent: Jul. 16, 2019

(54) LIGHTING DEVICE AND CORRESPONDING METHOD

(71) Applicant: OSRAM GmbH, Munich (DE)

(72) Inventor: Alessandro Bizzotto, Castelfranco Veneto (IT)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 15/574,499

(22) PCT Filed: May 10, 2016

(86) PCT No.: PCT/IB2016/052662

§ 371 (c)(1),
(2) Date: Nov. 16, 2017

(87) PCT Pub. No.: WO2016/185316

PCT Pub. Date: Nov. 24, 2016

(65) Prior Publication Data

US 2018/0128474 A1 May 10, 2018

(30) Foreign Application Priority Data

May 20, 2015 (IT) ..... 102015000016000

(51) Int. Cl.
*F21V 29/70* (2015.01)
*F21V 29/76* (2015.01)
(Continued)

(52) U.S. Cl.
CPC ..... *F21V 29/76* (2015.01); *F21K 9/00* (2013.01); *F21K 9/60* (2016.08); *F21K 9/90* (2013.01);
(Continued)

(58) Field of Classification Search
CPC ..... F21V 29/76; F21V 29/70; F21V 21/00; F21V 29/505; F21V 29/77; F21V 5/00; F21V 29/767; F21V 29/777; F21V 5/046; F21K 9/60; F21K 9/00; F21K 9/90; F21Y 2107/00; F21Y 2101/00
See application file for complete search history.

(56) References Cited

U.S. PATENT DOCUMENTS

2011/0103055 A1 5/2011 Carroll
2012/0243230 A1* 9/2012 Carroll ..... F21V 23/003 362/249.02

(Continued)

FOREIGN PATENT DOCUMENTS

WO 2009149263 A1 12/2009
WO 2015040240 A1 3/2015

OTHER PUBLICATIONS

International Search Report based on application No. PCT/IB/2016/052662 (11 pages) dated Jul. 19, 2016 (Reference Purpose Only).

*Primary Examiner* — Y M. Lee
(74) *Attorney, Agent, or Firm* — Viering Jentschura & Partner MBB

(57) ABSTRACT

According to the present disclosure, a lighting device is provided with a support member with a fork-like shape with two prongs carrying mutually facing electrically powered light radiation sources, and an annular heat sink member fitted onto the prongs and extending around the light radiation sources.

13 Claims, 4 Drawing Sheets

(51) Int. Cl.

| | |
|---|---|
| ***F21K 9/00*** | (2016.01) |
| ***F21K 9/90*** | (2016.01) |
| ***F21K 9/60*** | (2016.01) |
| ***F21V 21/00*** | (2006.01) |
| *F21V 5/00* | (2018.01) |
| *F21Y 101/00* | (2016.01) |
| *F21V 29/505* | (2015.01) |
| *F21V 29/77* | (2015.01) |
| *F21Y 115/10* | (2016.01) |
| *F21Y 107/00* | (2016.01) |

(52) U.S. Cl.

CPC ..... *F21V 21/00* (2013.01); *F21V 29/70* (2015.01); *F21V 5/00* (2013.01); *F21V 29/505* (2015.01); *F21V 29/77* (2015.01); *F21Y 2101/00* (2013.01); *F21Y 2107/00* (2016.08); *F21Y 2115/10* (2016.08)

(56) References Cited

U.S. PATENT DOCUMENTS

| | | | | |
|---|---|---|---|---|
| 2013/0294068 | A1* | 11/2013 | Kuenzler et al. ..... | F21V 7/048<br>362/234 |
| 2015/0062909 | A1 | 3/2015 | Progl et al. | |

* cited by examiner

LIGHTING DEVICE AND CORRESPONDING METHOD

RELATED APPLICATIONS

The present application is a national stage entry according to 35 U.S.C. § 371 of PCT application No.: PCT/IB2016/052662 filed on May 10, 2016, which claims priority from Italian application No.: 102015000016000 filed on May 20, 2015, and is incorporated herein by reference in its entirety.

TECHNICAL FIELD

The present description relates to lighting devices.

One or more embodiments may refer to lighting devices employing solid-state light radiation sources, such as LED sources.

BACKGROUND

The introduction and the increasingly widespread use of solid-state light radiation sources, such as LED sources, has opened new possibilities of implementation of lighting devices.

This is true e.g. for the retrofitting replacement of existing traditional light radiation sources, such as filament lamps, thereby offering improved mechanical, electrical, thermal and optical performances while preserving, as regards appearance and use, features which are substantially similar to traditional electrically powered light radiation sources.

While pursuing these goals, it is desirable to provide a good mechanical and thermal coupling without having to resort to additional elements, such as adhesives, fixation members etc.

Specifically, it is desirable to overcome those solutions which envisage e.g. mounting the light engine onto a heat sink by using fixation members, glues, biadhesive tapes etc.

SUMMARY

One or more embodiments aim at providing further improvements in this respect.

According to one or more embodiments, said object is achieved thanks to a device having the features specifically set forth in the claims that follow.

One or more embodiments may also concern a corresponding method.

The claims are an integral part of the technical teaching provided herein with reference to the embodiments.

One or more embodiments may offer one or more of the following advantages:

- an intrinsic simplicity, with a small number of parts and consequent savings in complexity and cost,
- the possibility of achieving an efficient coupling of the heat sink, the support element (e.g. a PCB), therefore facilitating cooling.

BRIEF DESCRIPTION OF THE FIGURES

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

In the following description, numerous specific details are given to provide a thorough understanding of exemplary embodiments. One or more embodiments may be practiced without one or several specific details, or with other methods, components, materials, etc. In other instances, well-known structures, materials, or operations are not shown or described in detail to avoid obscuring various aspects of the embodiments.

Reference throughout this specification to "one embodiment" or "an embodiment" means that a particular feature, structure, or characteristic described in connection with the embodiment is included in at least one embodiment. Thus, the possible appearances of the phrases "in one embodiment" or "in an embodiment" in various places throughout this specification are not necessarily all referring to the same embodiment. Furthermore, particular features, structures, or characteristics may be combined in any suitable manner in one or more embodiments.

The headings provided herein are for convenience only, and therefore do not interpret the extent of protection or the scope of the embodiments.

Figure 1:
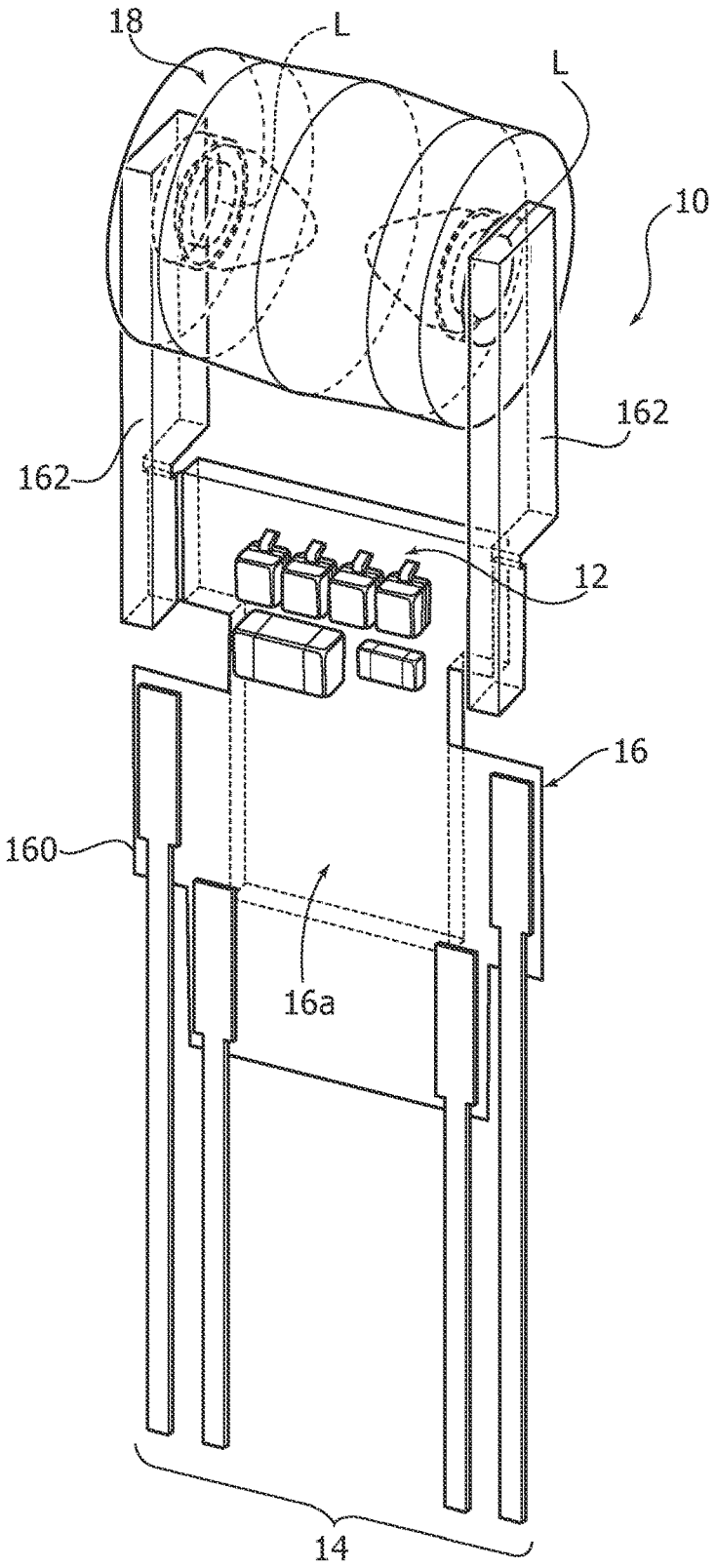
FIG. 1 is a perspective view of a lighting device which may comprise one or more embodiments.

In FIG. 1, reference 10 denotes a lighting device which employs electrically powered light radiation sources. In one or more embodiments, these may be solid-state light radiation sources, such as LED sources.

According to known criteria, sources L of this kind may be driven by drive circuits 12 connected to electrically conductive lines 14, which are adapted to provide power supply to light radiation sources L. One or more embodiments may also additionally include functions for a "smart" driving of sources L (i.e. dimming, thermal control, etc.).

One or more embodiments may allow for assembling device 10 without the need of fixation components.

For such purpose, device 10 may comprise a laminar support member 16 provided with mutually opposed surfaces (only a front surface 16*a* is shown).

In one or more embodiments, as exemplified in the Figures, laminar support member 16 may have a general fork-like shape, with a body portion 160 from which two prongs 162 extend.

Figure 2:
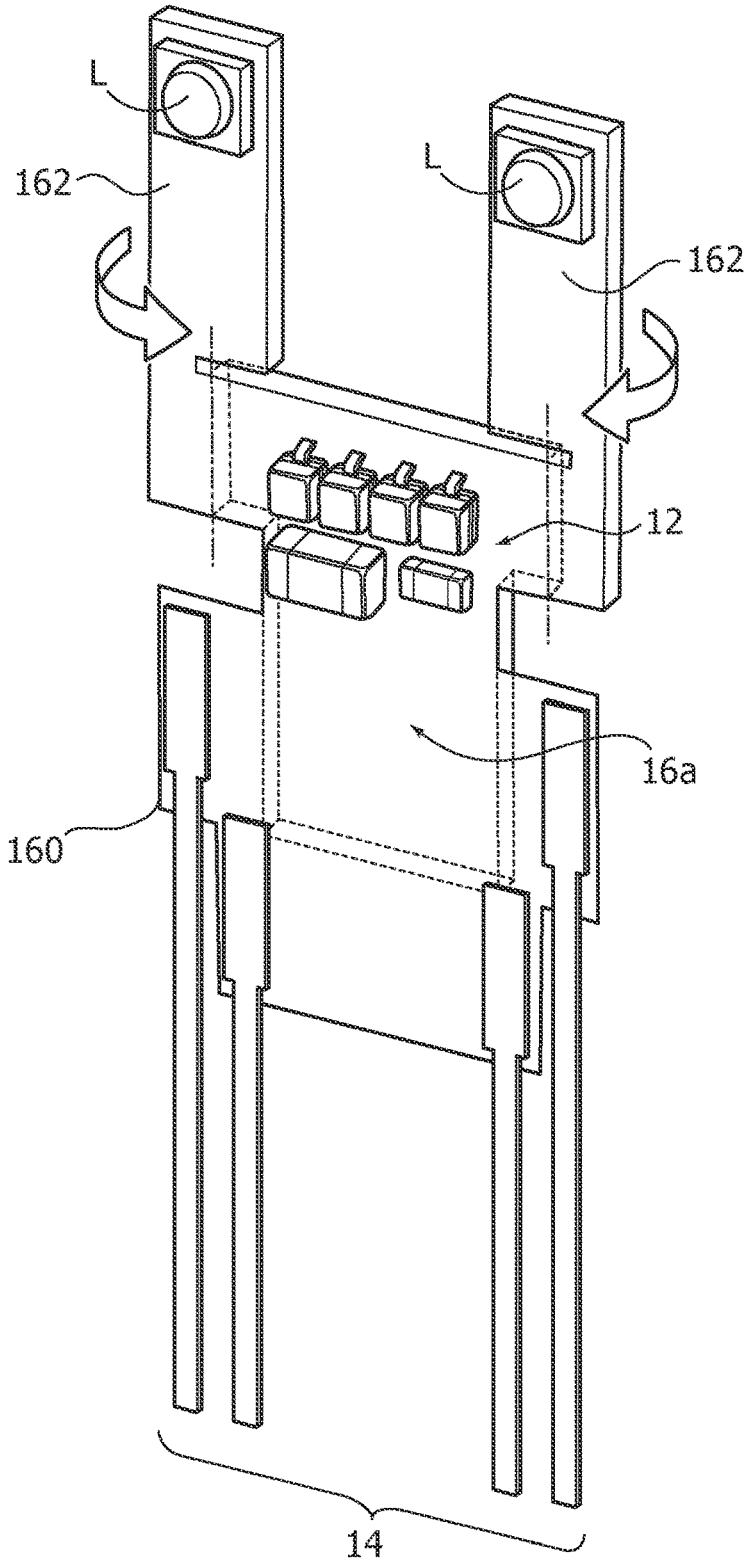
FIG. 2 shows a component adapted to be included into a device as shown in FIG. 1, FIGS. 3 and 4 show a possible mounting sequence of one or more embodiments.

Specifically, starting from a substantially planar initial shape (shown in FIG. 2) it is possible to impart a generally channel-like shape to support member 16 (at least in the proximal portion of prongs 162), as shown in the following Figures.

In one or more embodiments, circuits 12 and/or lines 14 arranged on first surface 16*a* of support 16 may be located within the channel-like shape, which may be obtained when prongs 162 are bent or folded with respect to body portion 160.

In one or more embodiments, light radiation sources L may be arranged on prongs 162 (e.g. on the face of such planar prongs corresponding to first surface 16*a*). As a result, when the prongs 162 are bent or folded with respect to body portion 160, light radiation sources L arranged on prongs 162 are mutually facing.

Although the presently exemplified embodiments refer to the presence of two light radiation sources L, which are located at the distal ends of prongs 162, one or more embodiments may envisage the provision, on each prong 162, of a higher number of light radiation sources L, and/or the arrangement of light radiation sources L in a position other than distal.

In one or more embodiments, the space between prongs 162 carrying the light radiation sources L may be left empty, so that the light radiation emitted by sources L propagates towards the surrounding environment.

In one or more embodiments, in the space between both prongs 162 carrying light radiation sources L there may be inserted, optionally before starting or completing the bending or folding movement of prongs 162, a spacer member, e.g. in order to keep prongs 162 ad a predetermined distance.

In one or more embodiments, in the space between both prongs 162 carrying light radiation sources L there may be inserted an optical element (such as e.g. one or more reflectors or a lens) acting on at least part of the light radiation emitted by sources L.

Figure 5:
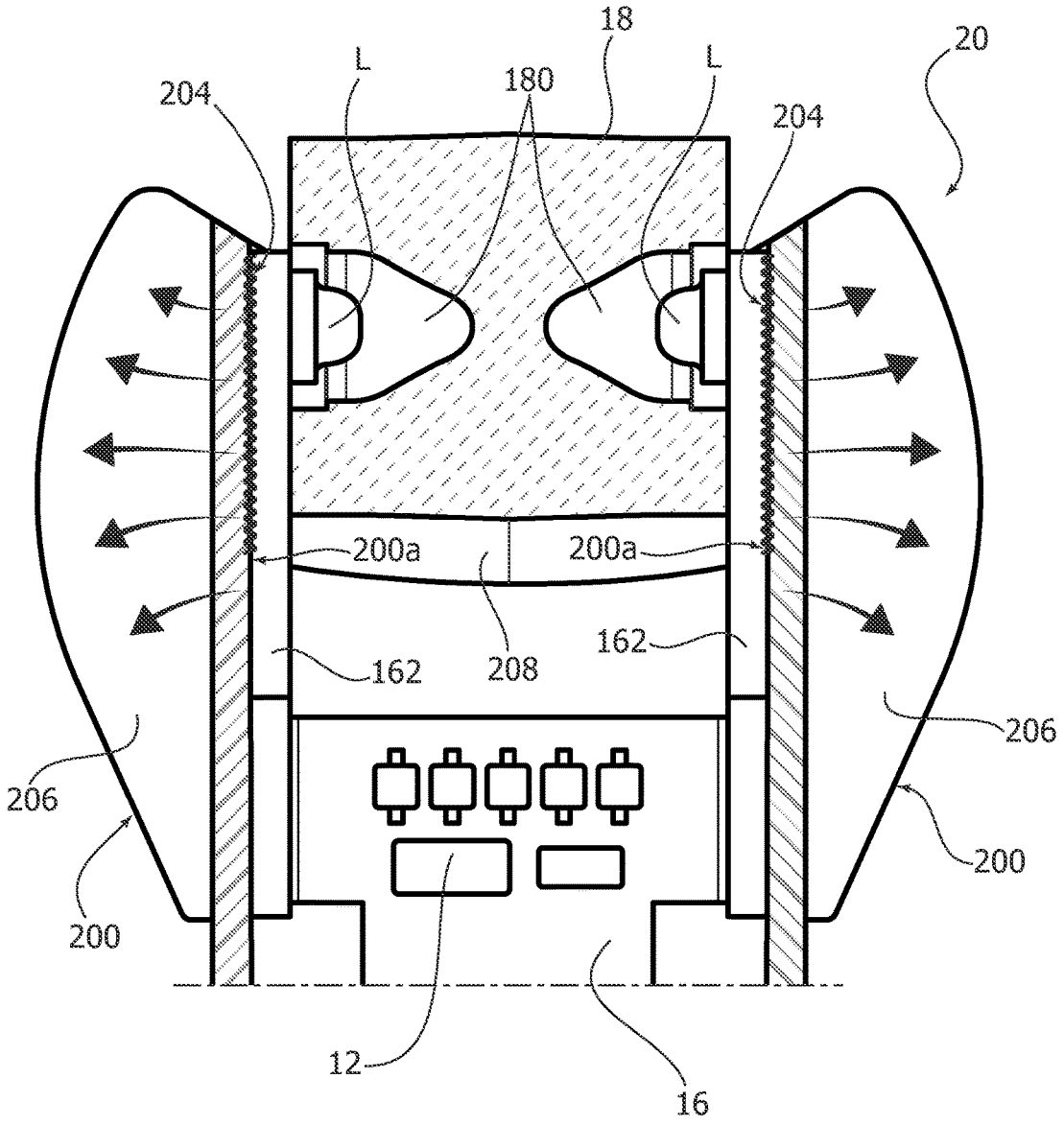
FIG. 5 is a view corresponding to a cross section of the upper part of FIG. 4, shown in enlarged scale.

In one or more embodiments, the functions of a spacer member and of an optical member may be performed by a single component, such as e.g. lens 18 exemplified in FIG. 5.

In one or more embodiments, component 18 may be provided with opposed end cavities 180, wherein light radiation sources L carried by the prongs will be inserted as a result of the bending movement imparted to such prongs 162.

In one or more embodiments, the supporting or holding action of component 18 between prongs 162 may be simply due to the fact that prongs 162 clamp, or so to say "pinch", component 18 therebetween. In one or more embodiments, the holding action by prongs 162 on component 18 may be strengthened by applying adhesive material between prongs 162 and optical member 18.

As exemplified in FIG. 1, in one or more embodiments it is therefore possible to obtain a lighting device 10 comprising:

- a fork-shaped support member 16, having a pair of prongs 162 carrying electrically powered, mutually facing light radiation sources L, and optionally
- a spacer member such as an optical member, e.g. a lens 18, arranged in the space between prongs 162 carrying mutually facing light radiation sources L.

Further details concerning the implementation of a lighting device such as device 10 in FIG. 1 may be found in an Italian Patent Application filed on the same date by the same Applicants.

Figure 3:
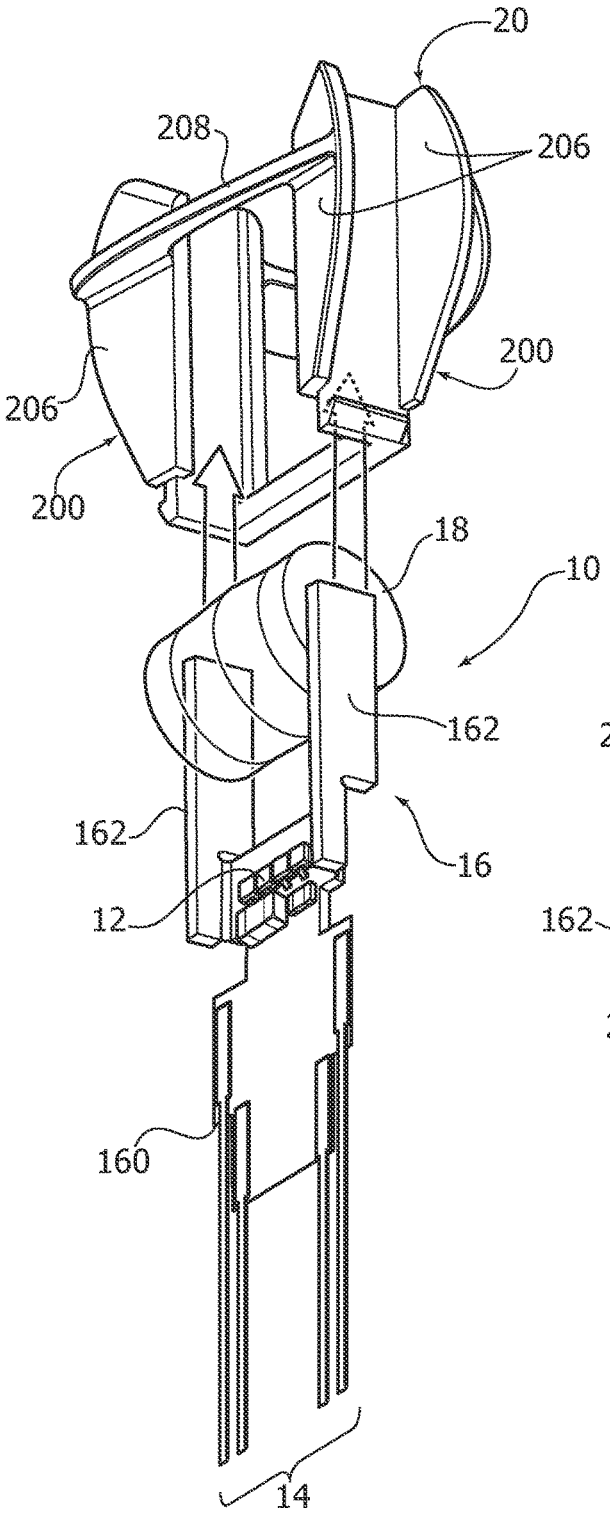

FIG. 3 and following exemplify the possibility of providing lighting device 10 with a heat sink 20, adapted to be fitted onto prongs 162 with member 18—if present—sandwiched therebetween. This may take place, e.g. as exemplified in the sequence of FIGS. 3 and 4.

Figure 4:
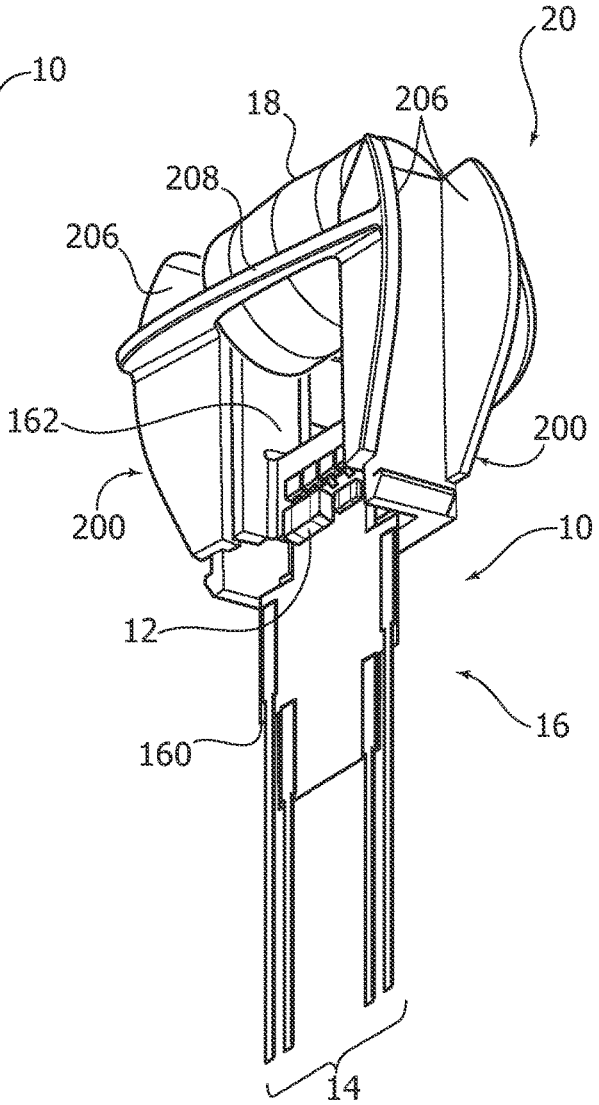

In one or more embodiments, heat sink 20 may have an annular shape, wherein device 10 may be inserted (i.e. fitted) in such a way as to achieve the final condition as exemplified in FIGS. 4 and 5.

In this condition, heat sink 20 is adapted to form a sort of collar fitted onto prongs 162, so that it can optionally perform, in addition to the function of a heat sink, a clamping of prongs 162 against the ends of component 18, if present; in this way, component 18 may be kept in the desired position, being interposed between light radiation sources L, without the need of further fixation means, e.g. the application of adhesive layers (which however is not excluded in one or more embodiments).

In one or more embodiments, heat sink 20 may be fitted onto prongs 162 through an interference fit. In this way, in one or more embodiments heat sink 20 may be mounted and held on device 10 without the provision of specific fixation or holding means.

In one or more embodiments, as exemplified in the Figures, heat sink 20 may comprise two mutually opposed bodies 200, located at the mutually opposed outer sides of prongs 162.

In one or more embodiments, such prongs 162 may comprise, as in the presently exemplified embodiments, laminar bodies, so that heat dissipating bodies 200 may have planar surfaces **200*a* (see FIG. 5) which may rest against corresponding and equally planar surfaces of prongs 162**, so as to achieve a (large) heat transfer surface from light radiation sources L.

In one or more embodiments, between surfaces **200*a* and prongs 162 there may be sandwiched a Thermal Interface Material (TIM) 204**.

In one or more embodiments, as exemplified in the Figures, heat dissipating bodies 200 of heat sink 20 may have the configuration of finned bodies, e.g. channel-shaped bodies having side walls 206. In one or more embodiments, side walls 206 may be mutually diverging.

In one or more embodiments, the general annular shape of heat sink 20 may include bridge-like members 208, extending between the heat dissipating bodies.

In one or more embodiments, bridge-like elements 208 may be configured as reflective surfaces, which act as reflectors. Further details concerning such option may be found in an Italian Patent Application filed on the same date by the same Applicants.

The view in FIG. 5 highlights that, in one or more embodiments, heat sink 20 may be sized in such a way that drive circuits 12 mounted on the support may face inwardly of heat sink 20, i.e. may be located in a position at least partially co-extensive with heat sink 20.

In one or more embodiments, heat sink 20 may have, in addition to bridge-like formations 208, further portions (e.g. the surfaces of side walls 206 facing outwardly of device 10) having reflective surfaces, so as to further contribute to the diffusive action of the light radiation emitted by sources L.

Of course, without prejudice to the basic principles, the implementation details and the embodiments may vary, even appreciably, with respect to what has been described herein by way of non-limiting example only, without departing from the extent of protection.

The extent of protection is defined by the annexed claims.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A lighting device, including:

a support member with a fork-like shape with two prongs carrying mutually facing electrically powered light radiation sources, a spacer component comprising opposing end cavities; wherein the two prongs press against both of the opposing end cavities of the spacer component to affix the spacer component between the two prongs; and an annular heat sink member fitted onto said prongs and extending around said light radiation sources.

2. The lighting device of claim 1, wherein said annular heat sink member is interference fitted onto said prongs.

3. The lighting device of claim 1, wherein said annular heat sink member includes heat dissipating bodies at the mutually opposed outer sides of said prongs.

4. The lighting device of claim 3, wherein said prongs include laminar bodies and said heat dissipating bodies include planar heat transfer surfaces against the laminar bodies of the prongs.

5. The lighting device of claim 3, wherein said heat dissipating bodies are finned bodies.

6. The lighting device of claim 3, including bridge-like members extending between said heat dissipating bodies.

7. The lighting device of claim 1, including electrical drive circuits for said light radiation sources, wherein said electrical circuits are arranged on said support member at a location at least partially co-extensive with said heat sink member.

8. The lighting device of claim 1, wherein said heat sink member includes at least one light reflective surface.

9. The lighting device of claim 1, wherein said electrically powered light radiation sources include solid-state light radiation sources.

10. The lighting device of claim 3, wherein said heat dissipating bodies are channel-shaped bodies with side walls forming heat dissipating fins.

11. The lighting device of claim 1, including an optical member between said mutually facing light radiation sources.

12. The lighting device of claim 1, wherein said electrically powered light radiation sources include LED sources.

13. A method of manufacturing a lighting device, including:

providing a support member with a fork-like shape with two prongs carrying mutually facing electrically powered light radiation sources, a spacer component comprising opposing end cavities; wherein the two prongs press against both of the opposing end cavities of the spacer component to affix the spacer component between the two prongs; and fitting an annular heat sink member onto said prongs around said light radiation sources.

* * * * *